United States Patent [19]

Winkler

[11] 3,937,390

[45] Feb. 10, 1976

[54] FISH BOX FOR STORING AND TRANSPORTING FISH

[75] Inventor: Klaus Winkler, Hattersheim, Germany

[73] Assignee: Ratio-Pack, Vienna, Austria

[22] Filed: Dec. 21, 1973

[21] Appl. No.: 427,272

[30] Foreign Application Priority Data

Dec. 21, 1972 Germany ..... 2262539

[52] U.S. Cl. ..... 229/23 R; 229/6 A; 206/448

[51] Int. Cl.[2] ..... B65D 13/00

[58] Field of Search ..... 229/23 R, 17 B, 6 A; 206/448

[56] References Cited

UNITED STATES PATENTS

| | | | |
|---|---|---|---|
| 1,225,705 | 5/1917 | Dyson et al. | 229/6 A |
| 1,826,197 | 10/1931 | Adams | 229/6 A |
| 2,032,799 | 3/1936 | Hagopian | 229/6 A |
| 2,077,047 | 4/1937 | Kondolf | 229/6 A |
| 2,697,348 | 5/1954 | Tichenor | 229/6 A |
| 2,809,775 | 10/1951 | White | 229/6 A |
| 2,984,343 | 5/1961 | Van Antwerpen et al. | 206/448 |
| 3,565,320 | 2/1971 | Osborne | 229/23 R |
| 3,713,579 | 1/1973 | Chaffers | 229/23 R |

*Primary Examiner*—Davis T. Moorhead
*Attorney, Agent, or Firm*—Browne, Beveridge, DeGrandi & Kline

[57] ABSTRACT

A box for fish or similar products is made of impregnated corrugated cardboard. The top and bottom of the box are complementarily shaped, both being higher at their centers than at their opposite sides. The sides of the box are provided with water drain holes which extend to the bottom of the box.

10 Claims, 12 Drawing Figures

Figure 1:
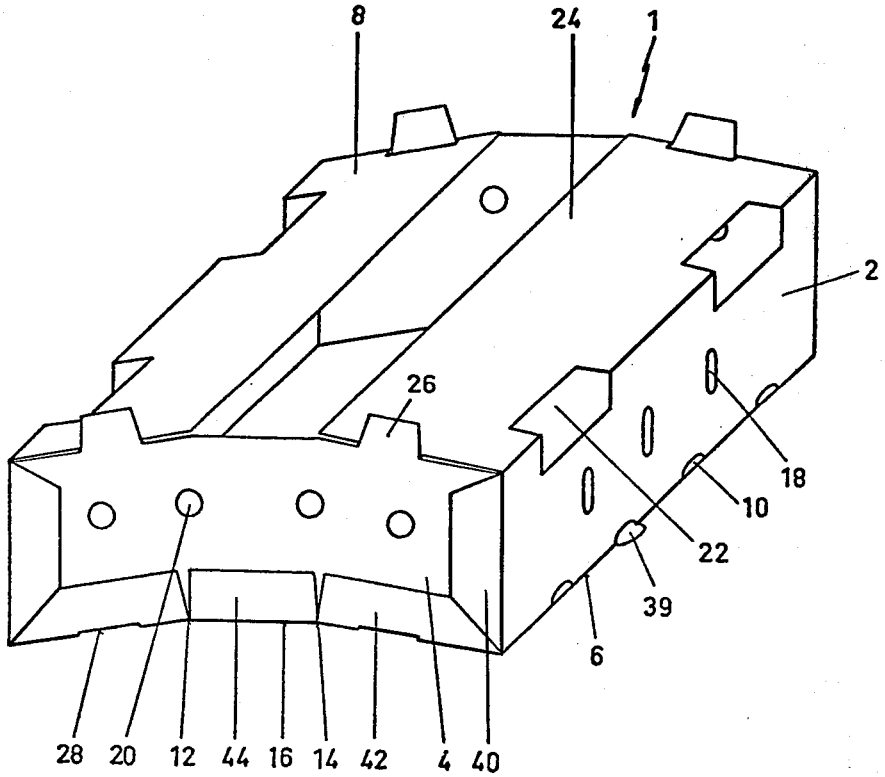

FIG. 7
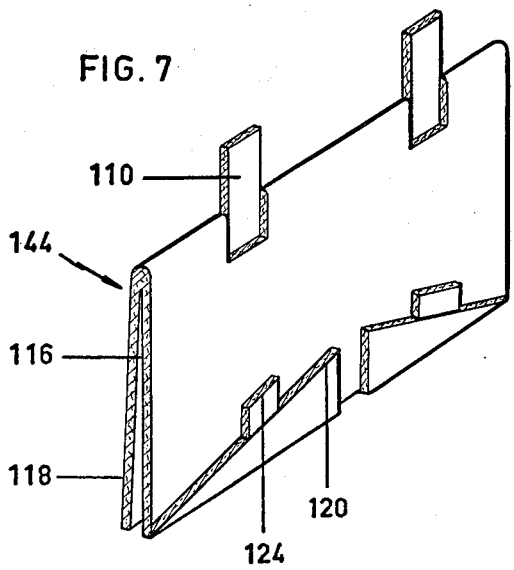
FIG. 8
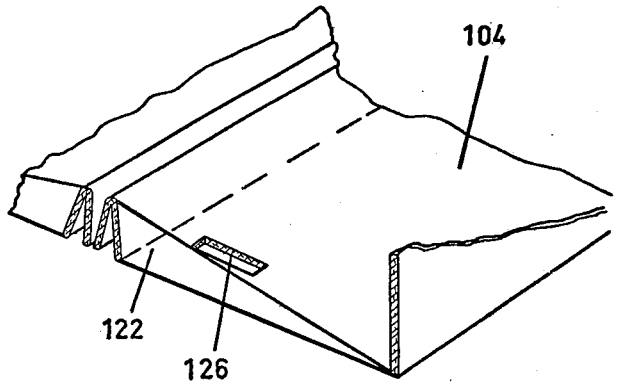
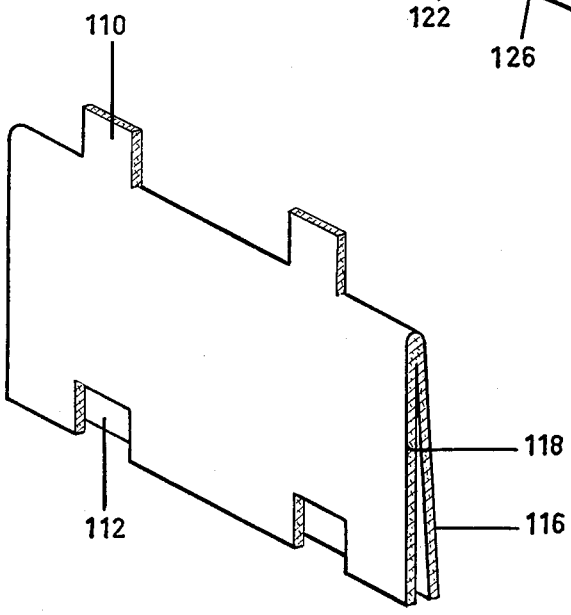
FIG. 9

FISH BOX FOR STORING AND TRANSPORTING FISH

The invention relates to a fish box.

Boxes made from wood and boxes made from plastic material have hitherto been used for packing fish for storage and dispatch purposes. The so-called "Swedish box" is a wooden box which has been developed, manufactured and introduced into the entire European area by the northern countries. It is used as a container for storing fish and is filled on board. Its dimensions of 190 × 500 × 780 mm also largely determine the construction of the fish holds of deep sea trawlers which have been built in recent decades. However, this wooden box no longer meets present-day requirements.

Its disadvantages include the following:

1. The wooden boxes taken on board cannot be stacked within each other and thus take up hold space and deck space before and during the catch.
2. Wooden boxes stored on deck are frequently lost during heavy weather.
3. When used as a non-returnable container, the box has become too expensive relative to its contents.
4. The box becomes a bacteria carrier when used as a returnable container, since it can only be superficially cleansed by means of a water jet and impairs the quality of the fish. Thus, this repeated use of the wooden box contravenes the hygiene regulations of individual European countries.
5. The wooden boxes stacked block, thus greatly imparing the circulation of cold air. Therefore, the fish are frequently preserved to only a limited extent.
6. When the boxes are stacked, water from thawing ice located on the fish, and slime from the fish, can enter the lower boxes from the upper boxes and spoil their contents.

A further disadvantage is the large amount of waste material resulting from the disposal of wooden boxes.

Owing to these disadvantages, fish caught at sea have, of late, been packed in boxes made from plastic material. These boxes are hygienic and can also be stacked, since they have side walls which widen conically upwardly and outwardly. However, owing to the conical shape of the boxes, draining water mixed with fish slime can enter the lower boxes through holes disposed in the sides or even in the bottom when the boxes are stacked one on top of the other. A single box containing spoiled fish can thus spoil the contents of all the lower boxes.

Moreover, owing to the high cost, it is necessary to make the plastic boxes sufficiently large and to use them repeatedly, although this is suitable only in the trade between producers and wholesalers (until the fish are auctioned at the fish market). However, the retailer, who requires different kinds of fish only in small quantities, and who also does not want to be bothered with the return of empty fish boxes, requires a convenient, inexpensive disposable container which reliably stores the fish for an adequate period of time (two to three days) and which he can dispose of without any great difficulty.

The object of the invention is to provide a fish box which occupies only a small amount of space before use, is inexpensive to manufacture and easy to dispose of, and which offers reliable protection against deterioration of the contents for a period of several days.

In accordance with the invention, this object is achieved in that the fish box is manufactured from impregnated corrugated cardboard provided with lateral water drain holes extending to the bottom, and that the top and bottom of the fish box are higher in the center than at the sides. This has the advantage that the fish box is made from a very inexpensive, readily disposable material. The impregnation prevents softening of the corrugated cardboard during the period of use of several days. The lateral water drain holes allow fresh air to enter and at the same time enable water and fish slime to drain off. The slope of the bottom towards the sides allows released fluid to drain off immediately, and fluid softening the corrugated cardboard cannot accumulate in the center of the bottom.

A large number of advantageous configurations of the fish box are possible. To be able to stack several boxes one on top of the other, the top of the box has the same configuration as the bottom, i.e. the top of the box is higher in the center than at one side. This also increases the capacity of the box.

The stacked boxes cannot slip relative to one another if the edges of the bottom of the box are provided with holes which receive projections formed in alignment therewith on a box located therebelow.

The box can be manufactured in a particularly simple manner if the bottom of the box slopes downwardly only towards one side. Alternatively, however, the bottom of the box can slope downwardly towards two oppositely located sides, or the cross section of the bottom can constitute an elliptical or circular segment or comprise a horizontal center portion and downwardly sloping portion contiguous to the sides thereof.

In order to provide drip projections at the water drain holes, the water drain holes can be punched-out such that an outwardly projecting flap is produced at the fold line between the side wall and the bottom.

Alternatively, however, it may be advantageous for the water drain holes at their top edge to have an inwardly directed flap. The contents of the fish box then cannot so easily block the water drain holes. Further, it is advantageous if, in accordance with a different embodiment, the inwardly directed flap is supported on the bottom or on the side wall.

In order to increase the stability of the fish box, particularly its stackability, and in accordance with a further development of the invention, the transverse sides of the fish box not provided with water drain holes comprise a plurality of glued portions of corrugated cardboard.

In accordance with other developments, improved ventilation can be obtained by providing additional ventilation holes, not extending to the bottom, in the sides in addition to the water drain holes.

Preferably, the ventilation holes are vertical slots, thus reducing the risk of fluid entering the box through the slots as it runs down the sides of the box on the outside.

The top of the box may also have ventilation holes. Alternatively, the top can be so constructed that the fish box is only partially covered. This results in a savings of material.

Alternatively, the top of the fish box can comprise two lids which may be opened and closed about their longitudinal axes and which, when closed, are retained in place by engaging projections which project upwardly from the transverse side.

An advantageous locking arrangement is also provided if one top lid engages under the other top lid when the fish box is being closed.

In a different embodiment, at least a portion of the inner fold lines of the box is provided with a sealing strip of adhesive in order to provide the box with better protection against the ingress of water.

In another development, the box has a solid, planar, closed top and the underside comprises two flap-like portions of cardboard having outwardly bent end portions, wherein the end portions abut against one another when the bottom is closed and raise the center of the bottom relative to the side edges, thus providing a possibility of drainage for the water.

To provide further support for the bottom formed in this manner, the sides of the flaps in the transverse direction can also have outwardly bent support strips which terminate in the support plane when the boxes are closed. The box can also be subdivided in the transverse direction by means of partitions.

The use of cardboard enables the boxes to be stored in the form of flat blanks, or even as raw cardboard which has to be cut and which, before use, is shaped and glued to form a box.

Further advantages and possibilities of use of the invention follow from the accompanying illustration of an embodiment and from the following description.

Figures 2, 2A, 2B:
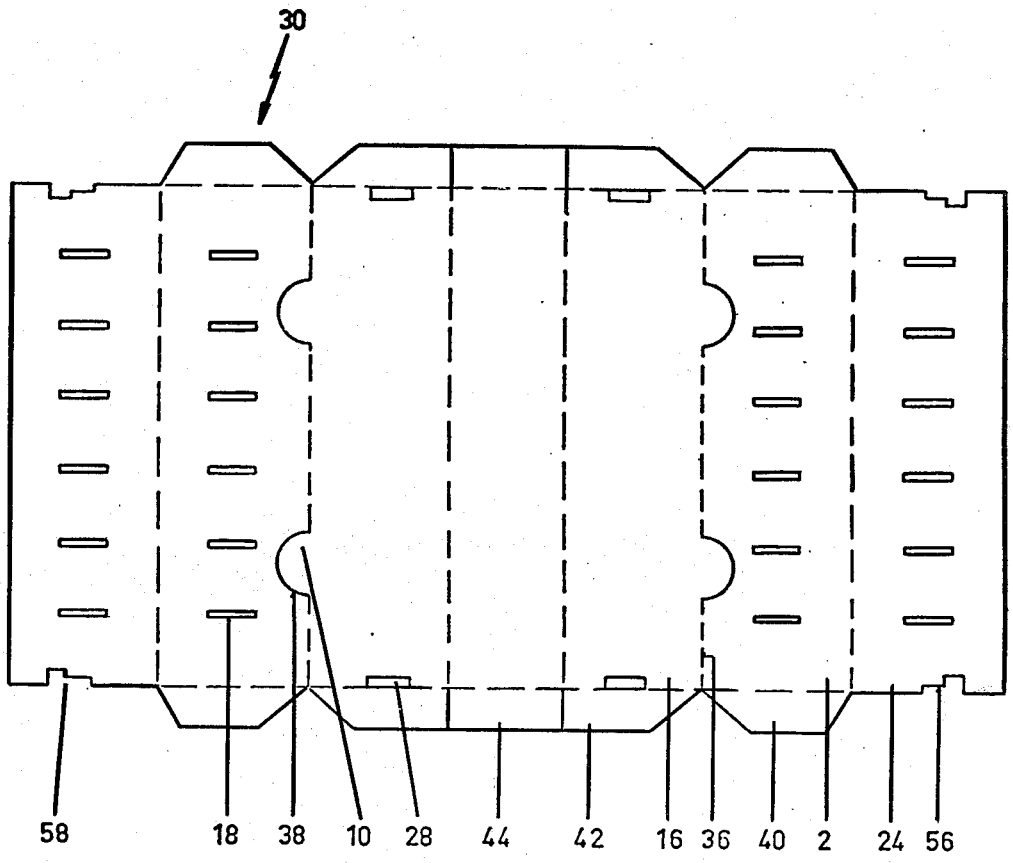

IN THE DRAWINGS:

FIG. 1 is a perspective view of one embodiment of the fish box according to the invention, FIG. 2 is a plan view of a punched-out part from which the bottom, longitudinal side walls and lid of the box of FIG. 1 can be produced, FIG. 2*a* and 2*b* show alternative shapes for cutaway portions in the edge of the lid, providing a projection which assists in retaining the lid in a closed position.

Figure 3:
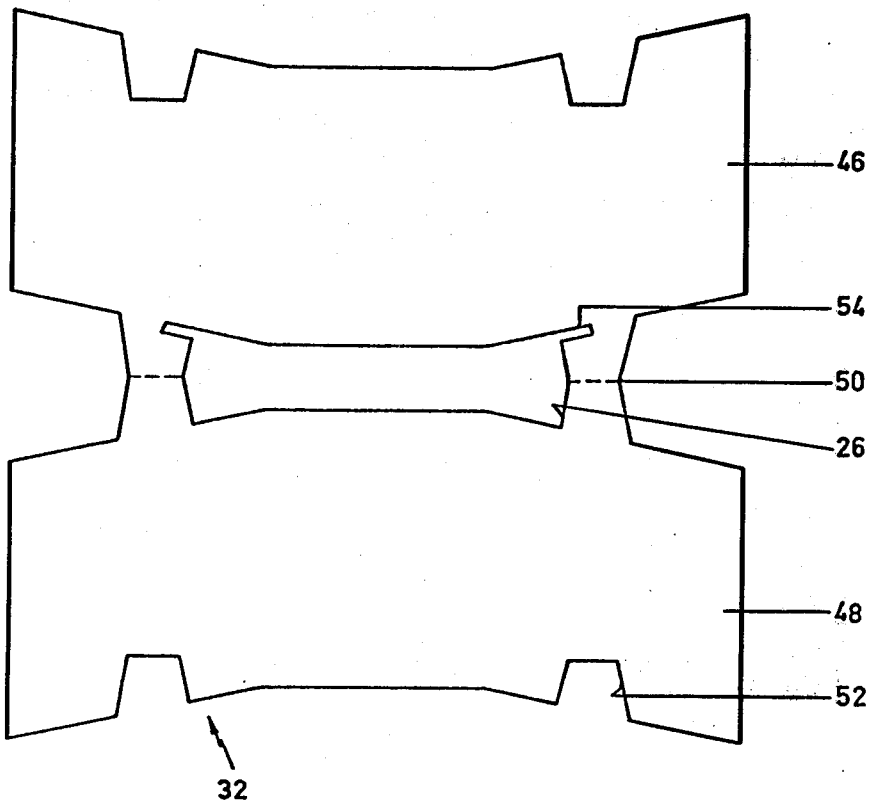
Figure 4:
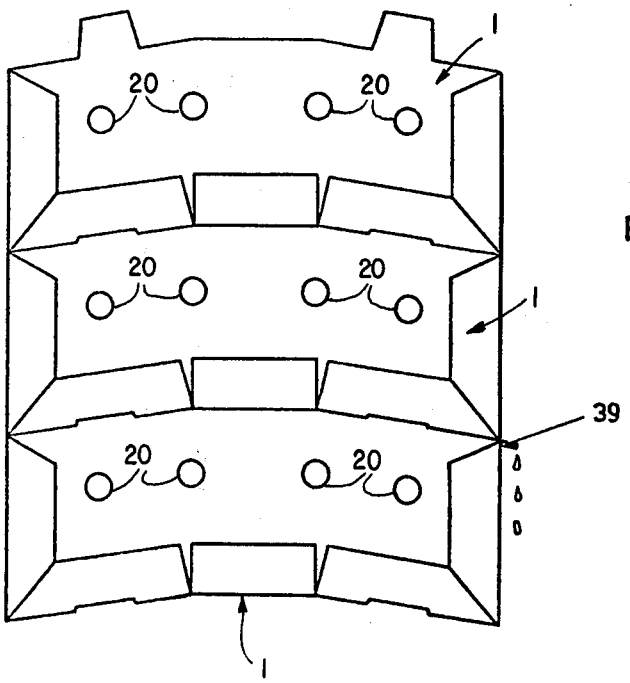
Figure 5:
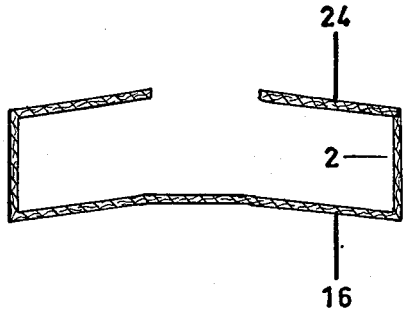
Figure 6:
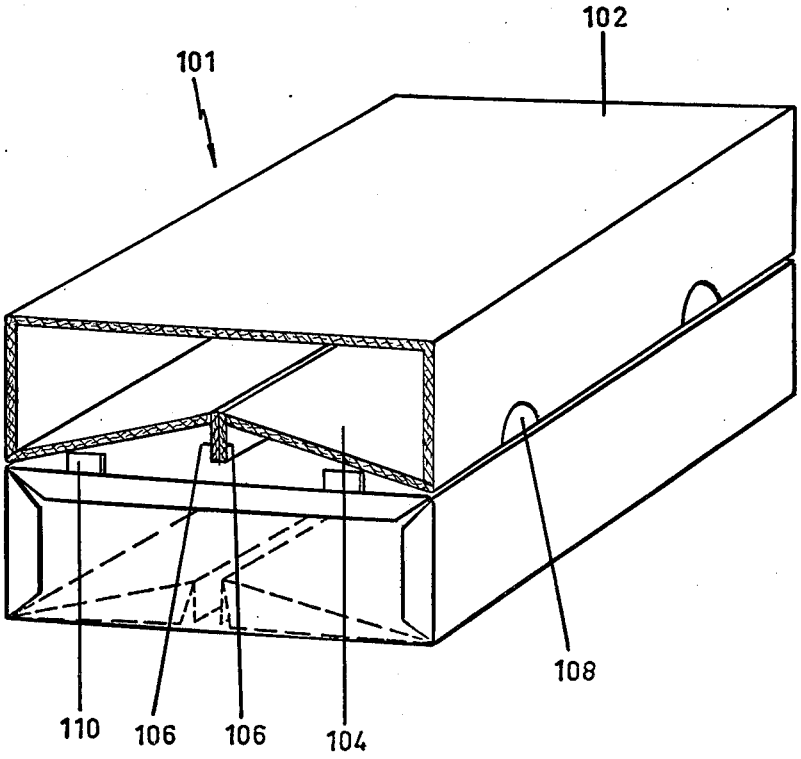
Figure 10:
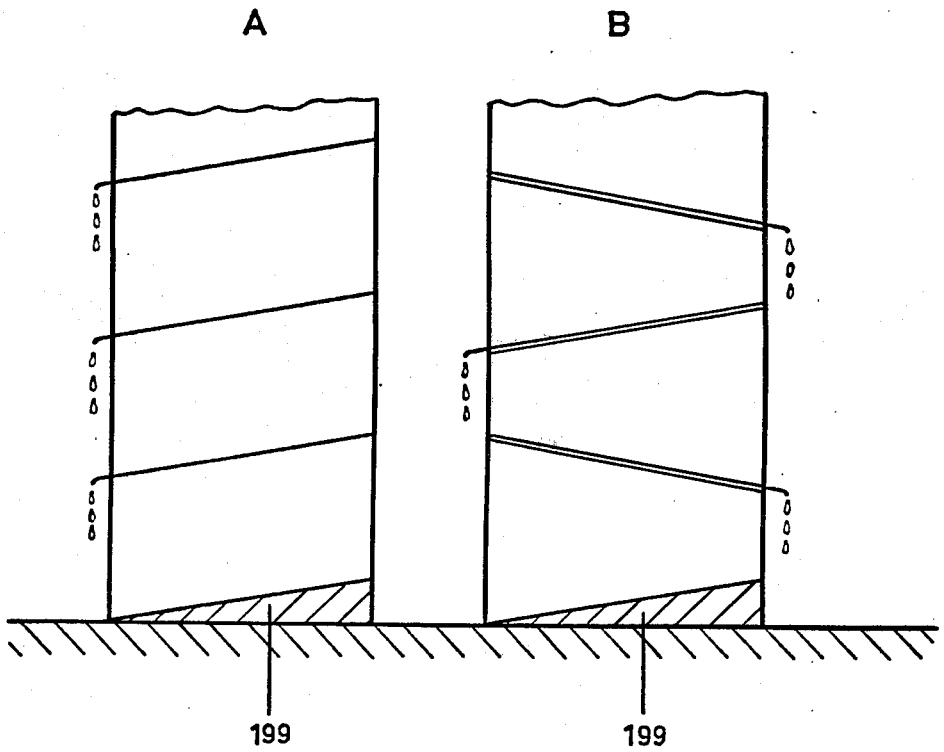

FIG. 3 is a plan view of a punched-out part from which one transverse side wall of the box of FIG. 1 can be produced, FIG. 4 is an end view of three fish boxes, constructed in accordance with the invention, stacked one on top of the other, FIG. 5 shows the bending arrangement for the part shown in FIG. 2 for manufacturing the box, FIG. 6 is a perspective view of a different embodiment of the fish box, showing two boxes stacked one on top of the other, one transverse side wall of the top box having been cut away, FIG. 7 is a perspective view of the inner side of the transverse side wall of the box of FIG. 6, FIG. 8 is a perspective view of a detail of the bottom of the box of FIG. 6, FIG. 9 is a perspective view of the outer side of the transverse wall of the box of FIG. 6, FIG. 10 is a schematic, sectional view of a plurality of stacked boxes in accordance with different embodiments of the invention, having a support part for the bottommost boxes.

One embodiment of the fish box 1 according to the invention is illustrated in perspective in FIG. 1. It comprises two side walls 2 extending in the longitudinal direction, two side walls 4 extending in the transverse direction, a bottom 6 and two lid flaps 8. The bottom 6 is convex in the transverse direction in order to allow liquid in the box to drain towards the sides from where it can emerge from the box through water drain holes 10. Furthermore, the convexity increases the stability of the bottom. The convexity of the bottom may be circular or elliptical. However, it is a simpler matter to produce a convexity by kinking the bottom surface. A kink in the center would produce a roof-shaped bottom. Two kinks 12, 14 (as shown in FIG. 1) produce a substantially planar center portion 16 which, however, is so narrow that no water can accumulate thereon and soak through the impregnated corrugated cardboard material from which the box is made. Alternatively, several kinks may be provided, although this complicates manufacture of the box.

In addition to the water drain holes 10 reaching to the bottom, ventilation holes 18, 20 are provided in the side walls, so that fresh air can circulate around the fish located in the box and the fish cannot become stifled. Preferably, the ventilation holes 18 in the longitudinal sides 2 should be vertical slots, since water draining from the water drain holes 10 in boxes located above, and running down the longitudinal sides 2, cannot readily enter the fish box through the holes 18. FIG. 4 shows a side view of boxes stacked in such a manner. The holes in the transverse sides 4 are not exposed to the same risk, so that the holes 20 may also be, for example, circular.

The embodiment illustrated in FIG. 1 is provided with further holes 22 which can act as further ventilation holes and as handles and through which the contents of stacked boxes can be inspected.

In the present instance, the box has two lid flaps 24 which leave a strip free in the center in order to allow air to enter from above in an unobstructed manner. The fish can also be introduced into the box through this opening. It is more advantageous if the lids can be swung upwardly. When the lids are closed, they engage the extensions 26 on the transverse walls 4, so that the lids cannot open unintentionally. The extensions 26 also act as guides for the box located above when a plurality of boxes are stacked. It is particularly advantageous to provide in the bottom of the box a complementary slot 28 to receive the extension 26.

Alternatively, the lids of the box can be omitted or they may be constructed such that they fully close the box. It is then advantageous if a small portion of one lid is guided below the other lid, in order to provide additional security against undesired opening of the lids.

In order to manufacture the box, a punched part 30 and two punched parts 32 (FIGS. 2 and 3) are punched or cut from one piece of corrugated cardboard. The punched part 30 forms the bottom 16, the longitudinal sides 2 and the lid flaps 24 of the fish box. The drain holes 10, ventilation holes 18 and guide holes 28 can be punched during the punching-out operation. It is advantageous to produce the drain holes 10 by producing a, semi-circular cut 38 in the subsequent side wall 2, commencing from the fold line 36. When the punched-out part 30 is subsequently bent to form the required shape of the box (FIG. 5), the semi-circle punched out of the side wall 2 provides a drip projection 39 (only one is shown in FIG. 1) which is connected to the bottom of the box and which allows the water to drip off so that it does not run downwardly along the wall of the box. (FIG. 4).

The punched part 30 is provided with lateral flaps 40, 42, 44 which are subsequently folded over and glued to the transverse walls (FIG. 1).

FIG. 3 shows the punched part 32 which forms one transverse side of the box. The punched part 32 forms two substantially identical halves 46, 48 which are folded together about at least one fold line 50 and glued, thus providing the transverse sides with a double thickness. This renders the box more resistant to the bearing load when several boxes are stacked one on top of the other. Alternatively, a single wall would suffice in the case of a small bearing load. Further walls may be added if the bearing load is high.

The configuration of the side wall naturally depends upon the desired convexity of the bottom and the corresponding convexity of the top of the box.

The projections 26 are formed during punching-out of the part 32, as well as the cut-away portions 52 which subsequently form slots 28, 34 in the transverse side wall of the box to receive the projections 26 when stacking the boxes, for the purpose of aligning and securing the individual boxes 1 relative to one another.

One side of the projection 26 has a slot 54 which serves to retain the lid in its closed position. The slot 54 receives a lateral projection 56 (FIG. 2) located in the cutaway portion 58 on the edge of the lid. This form of lid locking device is particularly durable and even allows the box to be opened and closed many times without the projection 56 losing its rigidity.

Alternative shapes of lid-retaining projections are shown in FIGS. 2*a* and 2*b*. In FIGS. 2*a* and 2*b*, the projections 56*a* and 56*b* are formed by sloping edges which occupy; about two-thirds of the width of the cut-away portion. In FIG. 2*a*, the projection 56*a* extends about two-thirds of the depth of the cutaway portion, and in FIG. 2*b*, it occupies or the full depth.

As already mentioned, the box is made from corrugated cardboard which is inexpensive and which is also readily disposable. It is advantageous to provide the corrugated cardboard with a water-repellent impregnation in order to increase resistance to softening. Tests with a fish box having dimensions of 40 × 60 × 15 cm, in accordance with the embodiment shown in FIG. 1, showed that a box containing fish and ice retained its full stability after being stored for 72 hours in a cold-storage room. The absorption of water was 100 g.

The corrugations of the corrugated cardboard should extend vertically on the transverse side walls in order to obtain optimum stacking stability. It is more advantageous for the corrugations to extend horizontally on the other sides of the box, owing to the large number of bending edges extending in this direction and the small probability of penetration by water.

In order to particularly protect the cut edges of the box against penetration by water, a sealing strip of adhesive can be additionally applied within the box, particularly at the perpendicular and bottom horizontal joining lines between the parts 30 and 32. The corrugated cardboard has a large number of cavities and also good thermal insulating properties which correspond to those of "Styropor". Thus, ice added to the fish thaws more slowly in the case of largely closed boxes stored in a normal environment.

FIGS. 6 to 9 show a different embodiment in which the top 102 of the box 101 forms a horizontal, substantially closed surface (FIG. 6). The fish are introduced into the box from the bottom (or the box is filled from the top, closed and turned over). The convex bottom 104 is formed by the lids of the box which are supported against one another by outwardly bent edges 106. The box also has drain openings 108. Air holes (not shown) can also be provided.

Extensions 110 and cut-away portions 112 again serve to locate boxes stacked one on top of the other (FIG. 6).

Here, also, the transverse side portions 114 (FIGS. 7 and 9) comprise two glued layers 116, 118, the layer 116, located inwardly in the finished box, being bent through 180° at the bottom end and forming a further support wall 120 for the bottom 104. The bottom has a side flap 122 which is located between the layer 116 and the support wall 120 when closing the box. Furthermore, a projection 124 of the support wall 120 engages into an opening 126 in the bottom 104 and locks the support wall after the lids have been closed.

FIG. 10 shows a simplified form of a fish box according to the invention. In this instance, the bottom is shown only towards one side in which the drain holes are located. According to the construction of the top of the box (parallel to the bottom as shown in embodiment A, or at an angle thereto as shown in embodiment B), these boxes can also be stacked conveniently when a bottom support part 199, inclined in the same manner as the bottom of the box, is used.

Other commodities which have to be cooled with ice which produces water, or which themselves produce fluid, such as vegetables, meat, shell-fish etc., can also be stored in the fish boxes for a limited period of time.

I claim:

1. Fish box for the storage and transportation of fish and similar products, comprising impregnated corrugated cardboard forming a top, a bottom and side walls, said side walls having lateral water drain holes which extend to said bottom, said bottom of the fish box being higher in the centre than at two opposite sides, said top being higher in the middle than at said two opposite sides to complement said bottom.

2. Fish box as claimed in claim 1, characterised in that the bottom of the box has positioning holes, said box having upwardly-extending projections formed in alignment with said positioning holes to extend into said positioning holes on a box thereabove.

3. Fish box as claimed in claim 1, characterised in that the top and the bottom of the box slope downwardly towards two oppositely located sides.

4. Fish box as claimed in claim 1, characterised in that the bottom comprises a horizontal central portion and downwardly sloping portions contiguous to the sides thereof.

5. Fish box as claimed in claim 1 having an outwardly directed flap at the water drain holes, said flap being located at the fold line between the side wall and the bottom.

6. Fish box as claimed in claim 1 having an inwardly directed flap at the top edge of the water drain holes.

7. Fish box as claimed in claim 6, characterised in that the inwardly directed flap is supported on said bottom.

8. Fish box as claimed in claim 1, characterised in that the top of the fish box comprises two lids which may be open and closed by swinging about longitudinal axes, projections which project upwardly from the transverse sides and which are provided with a cut-away portion receiving edge portions of said lids.

9. Fish box as claimed in claim 8, characterised in that one of the lids engages under the other lid when closing the fish box.

10. Fish box as claimed in claim 1, characterised in that at least a portion of the edge of the corrugated cardboard is provided with a sealing strip of adhesive.

* * * * *